US008453399B2

(12) United States Patent
Anderson

(10) Patent No.: US 8,453,399 B2
(45) Date of Patent: Jun. 4, 2013

(54) ROOF BATTEN

(75) Inventor: Ted F. Anderson, Cameron Park, CA (US)

(73) Assignee: Battens Plus, Inc., El Dorado, CA (US)

( * ) Notice: Subject to any disclaimer, the term of this patent is extended or adjusted under 35 U.S.C. 154(b) by 1934 days.

(21) Appl. No.: 10/830,821

(22) Filed: Apr. 23, 2004

(65) Prior Publication Data

US 2005/0000172 A1 Jan. 6, 2005

Related U.S. Application Data

(63) Continuation-in-part of application No. 10/386,977, filed on Mar. 12, 2003, now abandoned.

(60) Provisional application No. 60/364,671, filed on Mar. 13, 2002.

(51) Int. Cl.
*E04C 2/52* (2006.01)
*E04D 1/00* (2006.01)

(52) U.S. Cl.
USPC ..... 52/220.2; 52/220.3; 52/309.1; 52/553

(58) Field of Classification Search
USPC ..... 52/220.2, 220.3, 309.1, 553, 177
See application file for complete search history.

(56) References Cited

U.S. PATENT DOCUMENTS

| | | | | |
|---|---|---|---|---|
| 2,361,112 | A | 10/1942 | Llewellyn | |
| 3,236,170 | A | 11/1962 | Meyer et al. | |
| 3,984,958 | A | 10/1976 | Murray | |
| 4,676,147 | A | 6/1987 | Mankowski | |
| 4,817,506 | A | 4/1989 | Cashman | |
| 4,899,505 | A | 2/1990 | Williamson et al. | |
| 4,958,471 | A | 9/1990 | Waddington | |
| 5,112,278 | A | 5/1992 | Roberts | |
| 5,309,685 | A | 5/1994 | Rathgeber et al. | |
| 5,419,867 | A | 5/1995 | Van Erden et al. | |
| 5,471,807 | A * | 12/1995 | Vasquez | 52/553 |
| 5,570,555 | A | 11/1996 | Ferguson et al. | |
| 5,651,734 | A | 7/1997 | Morris | |
| 5,711,116 | A | 1/1998 | Hasan | |
| 5,947,817 | A | 9/1999 | Morris et al. | |
| 6,067,764 | A * | 5/2000 | Johansen | 52/302.1 |
| 6,357,193 | B1 * | 3/2002 | Morris | 52/553 |
| 6,393,796 | B1 | 5/2002 | Goettl et al. | |
| 6,599,184 | B2 | 7/2003 | Morris | |
| 7,169,460 | B1 * | 1/2007 | Chen et al. | 428/195.1 |

* cited by examiner

*Primary Examiner* — Brian Glessner
*Assistant Examiner* — Adriana Figueroa
(74) *Attorney, Agent, or Firm* — Carl J. Schwedler

(57) ABSTRACT

A roof batten integrally-formed of plastic with spaced, generally parallel upper and lower surfaces and a series of struts connecting the upper and lower surfaces, to form chambers permitting the fluid passage from the back edge to the front edge of the batten when it is affixed generally horizontally along a roof surface.

19 Claims, 3 Drawing Sheets

ROOF BATTEN

This application is a Continuation in Part of U.S. patent application Ser. No. 10/386,977, filed or Mar. 12, 2003, now abandoned, which claims benefit of U.S. Provisional Patent Application Ser. No. 60/364,671, flied on Mar. 13, 2002.

BACKGROUND OF THE INVENTION

1. Field of the Invention

This invention relates to roof battens used for applying tiles to a roof, and, more particularly, to a batten product integrally-formed of plastic.

2. Description of Related Art

Tile roofs typically include several layers of materials. Over the trusses and/or rafters there is often a layer of exterior plywood or other sheathing, covered with roofing paper or felt which is conventionally applied, the tile underlayment. Roof battens are applied directly to this underlayment, with the tiles overlaying the battens.

Roof battens are conventionally produced as 1 inch by 2 inch wooden elements. Battens are typically secured to a sloping roof in generally horizontal lines, such as through nailing, screwing or stapling, at intervals dictated by the tiles to be applied over the battens. An element on the tiles is supported along the elevated back edge of the batten.

While battens are useful in applying tiles to a roof, there are deficiencies in the traditional batten, foremost among them being the tendency of such battens to collect water on the roof surface underneath the tiles. When wood battens are used, water which has seeped through or between the tiles will accumulate behind the battens and form small pools. When water collects or stands in this manner, it will often infiltrate the paper or felt layer and into the underlying structure of the roof, leading to roof deterioration, interior mold, and permanent damage.

As traditionally assembled, battens create a dam behind the tiles, which can lead to storage of water on the underlayment. This pooling can set up damage to a large portion of the felt underlayment. Even double felting a tile roof will not protect it if large quantities of water are collecting on the roof surface, as it will eventually find its way into the underlayment.

The felt underlayment should be the last line of defense, as once the underlayment has failed, moisture makes its way into the house. Once water finds its way beneath the felt underlayment, the sheathing itself begins to fail, as water will make its way to any seam and then into the house. Internal dry rot and rotting sheetrock, mold, etc., is the result.

In U.S. Pat. No. 5,570,555, issued Nov. 5, 1996, to Ferguson et al., a solution to the problem of water pooling is proposed utilizing a double batted system, with a layer of vertically disposed battens underlaying and supporting the horizontal battens that support the tile. This provides a complicated construction, with double layers of sheathing and battens required to assemble the roof.

In U.S. Pat. No. 6,393,796 B1, issued May 28, 2002, to Goettl et al., battens are proposed of formed sheet metal with an inverted vee in cross-section, with the peaked portion of the vee elevated and supporting the tiles. Small holes are provided where each leg of the vee contacts the roof surface, to supply drainage in a vertical direction along the roof surface. An additional proposed advantage for such battens is their stackability. The use of metal sheathing, however, adds to the weight and expense of this product over the traditional wooden batten.

A plastic batten with external grooves formed along one surface is described in U.S. Pat. No. 5,471,807, issued Dec. 5, 1995, to Vasquez. The grooves are disposed along the surface of the roof, to allow vertical drainage of accumulated water. However, with this design, the grooves can easily become clogged by accumulations of dirt and debris, minimizing the drainage achieved in practical application.

Another plastic batten is disclosed and claimed in U.S. Pat. No. 6,359,193, issued Mar. 19, 2002, to Morris. This patent discloses a multi-ply plastic batten with one of the plies folded to form corrugations. In the construction layers of material, the plies, are fused with one ply forming a corrugated level, and then the corrugated units are stacked and further fused, and finally cut into a batten. The resulting product has a multiplicity of passages formed by the corrugated layer in each layer of the structure for drainage in a vertical direction down the roof.

Batten designs that elevate the attachment layer over an open structure underneath, such as the double batted system, are complicated to produce and increase the cost of the roofing, in many cases requiring the use of special tiles for use with the roofing system.

Single layer battens with grooves, chambers or other openings provided for drainage and ventilation are susceptible to clogging from the dirt and debris that collects between battens on the roof surface. The debris may be left over from the construction, or originate from the activity of animals and insects, wind or rainwater. Providing more frequent holes in the current designs would weaken the batten, by increasing the non-supporting regions of the batten.

Thus there is need for a roof batten that will provide adequate ventilation and drainage to eliminate the pooling of water on the roof surface, and which is easy to produce, low in price, lightweight, strong, and easily installed.

SUMMARY OF THE INVENTION

This invention pertains to roof battens used for supporting tiles on a roof. The batten is conventionally attached over roofing paper in a spaced relationship with the tiles set thereupon. The batten is configured such that ventilation and drainage of the area under the tiles is maximized, while providing a batten with superior strength that can be produced at a favorable price.

More particularly, the invention provides a roof batten integrally-formed of plastic with spaced, generally parallel upper and lower surfaces and a series of struts connecting the upper and lower surfaces. The struts, with the upper and lower surfaces, form chambers permitting the passage of water from the back edge to the front edge of the batten when it is affixed generally horizontally along a roof surface. The upper and lower surfaces and said struts are formed having a thickness of at least about 1/32 inch.

In a preferred embodiment, the struts are spaced regularly and the chambers are generally aligned with one another. In one such embodiment, the struts are formed generally perpendicular to the upper and lower surfaces, and each of the chambers has a generally rectangular profile when viewed from the front. Another such embodiment has a generally trapezoidal profile when viewed from the front.

In a further preferred embodiment, when seen in profile from the front, the two-dimensional presentation of the structural elements, both the surfaces and the struts, occupy an area that is at least about 75% or less than the profile area of the chambers. The square area in the profile occupied by the structural elements is preferably less than about half, more preferably about 40%, and even more preferably as little as about 33% or less of the chamber area.

Other preferred battens will have at least about ⅜ inch, and more preferably, at least about ½ inch between spaced struts. In a further preferred embodiment, when viewed in profile, each of the chambers has a open square area of at least about 1 square centimeter.

In another preferred embodiment, the struts increase in thickness from a central region of the strut between the upper and lower surfaces and a region near the connection of each strut with the upper and lower surfaces, by at least about 10%, or, in certain alternative embodiments, by at least about 20%, 30% or more in thickness.

The roof batten is preferably produced by extrusion of a sheet of upper and lower surfaces, with the battens formed by cutting the extruded sheet along adjacent front and back edges of adjacent battens. In this embodiment, the extrusion uses a die profiled for forming the rectangular or trapezoidal chambers formed between the spaced surfaces and the struts.

The roof batten preferably produced with at least about 18 inches between the ends, though in further preferred embodiments, the distance is at least about 36 inches, and most preferably, at least about 48 inches between the ends.

The invention also provides a method of making a roof batten comprising the steps of extruding a sheet of plastic through a die, where the die has a cross-sectional profile configured to produce spaced, generally parallel upper and lower surfaces and a series of struts connecting the upper and lower surfaces, where the upper and lower surfaces and the struts have a thickness of at least about 1/32 inch, the spaced surfaces are separated by at least about ⅝ inch, and the struts are spaced so as to form hollow chambers therebetween extending in the direction of extrusion. The struts are preferably spaced regularly with the chambers generally aligned with one another.

The extruded plastic is cut transversely to the direction of extrusion so as to provide a series of roof battens having front and back edges separated by at least about 1¼ inch, though it may be at least about 1½ inch, or even at least about 2 inches, or at least about 3 inches, depending on the application.

In a preferred such method a sheet of plastic is extruded for a plurality of such battens.

Roof battens formed by such a method are also provided by this invention.

The battens of the present invention provide superior ventilation and drainage to eliminate the pooling of water on the roof surface, by virtue of the large chambers and the greater fluid exchange among spaces located between battens. When extruded and cut, the battens are easy to produce, low in price, lightweight, strong, and easily installed.

The batten is capable of supporting 200 pounds of pressure over an area 3 inches in diameter. An extruded or molded plastic batten of polypropylene is preferred. The plastic is further susceptible of being affixed to a roof by any of nailing, stapling, or screwing means. They are easily secured to a roof and receive and support the roofing tiles conveniently.

While the battens of the present invention have been described as preferably being made of polypropylene plastic, they may be made of any other suitable plastic material, or the like. As they are produced integrally of a single piece, unlike prior art battens, they will not warp or split upon expanding and contracting with the normal extreme weather and temperature conditions experienced on a roof.

The battens may alternatively be produced of recycled plastic material.

These and other features and advantages of this invention are described in, or are apparent from, the following detailed description of various exemplary embodiments of the apparatus and methods according to this invention.

BRIEF DESCRIPTION OF FIGURES

Various exemplary embodiments of this invention will be described in detail, with reference to the following Figures, wherein.

DESCRIPTION OF THE PREFERRED EMBODIMENT

Figure 1:
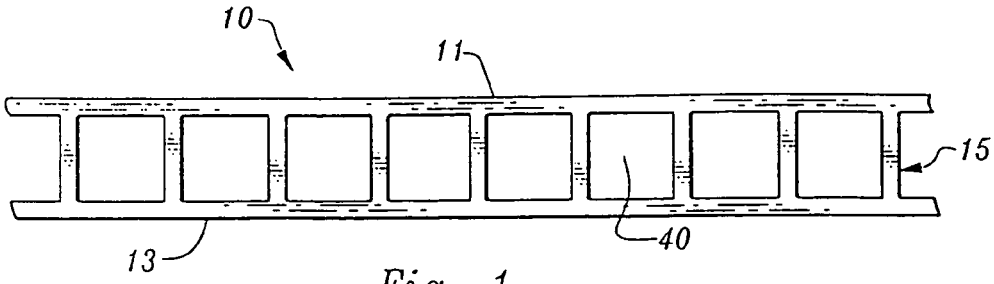
FIG. 1 is a front elevational view of the batten of this invention.

Reference is made to FIG. 1 wherein the batten 10 is seen in front elevation of the batten. The batten 10 is integrally-formed of plastic with spaced, generally parallel upper and lower surfaces 11 and 13 and a series of struts 15 connecting the upper and lower surfaces.

Figure 2:
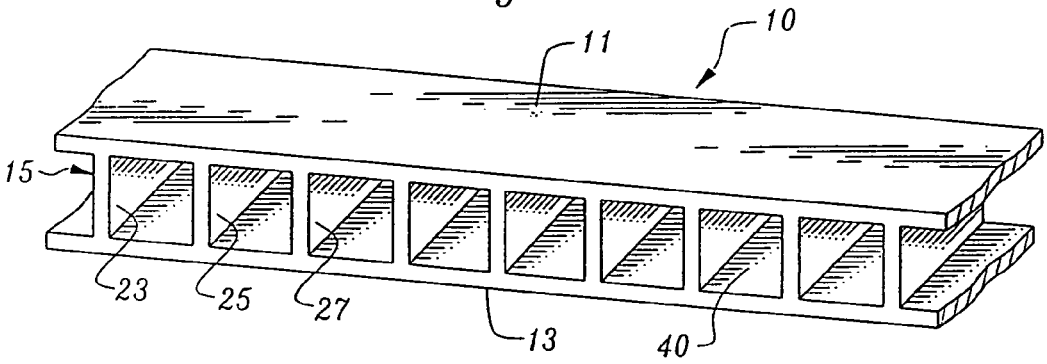
FIG. 2 is a top perspective view thereof.
Figure 3:
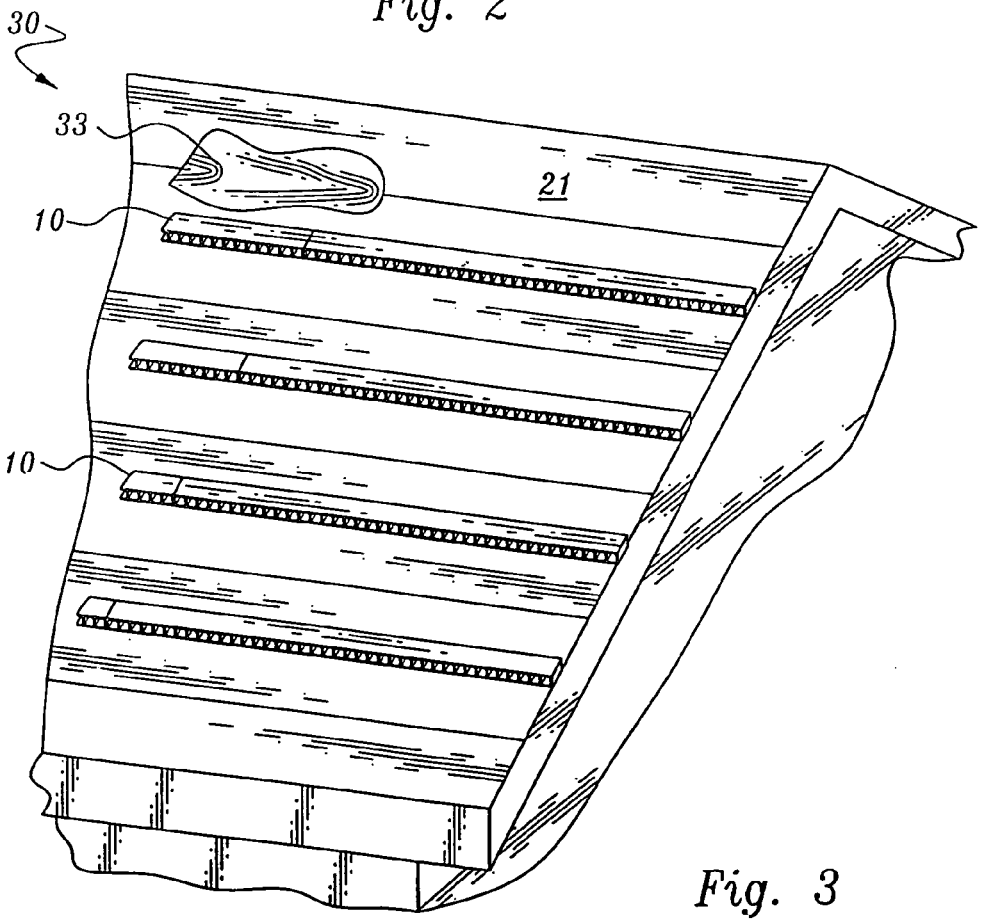
FIG. 3 is a typical pitched roof installation of the battens of this invention.

As seen with reference to FIG. 2, a top perspective of the batten, adjacent struts 23, 25 and 27, together with the upper and lower surfaces 11 and 13, form the chambers 40 permitting the passage of fluid from the back edge to the front edge of the batten when it is affixed generally horizontally along a roof surface (see FIG. 3). Each chamber 40 is bounded on its top and bottom by a segment of the upper and lower surfaces 11 and 13, and on its two sides by any two spaced adjacent struts 15.

The upper and lower surfaces 11 and 13 and said struts 15 are formed having a thickness of at least about 1/32 inch. The spaced surfaces are preferably separated by at least about ⅝ inch, while the batten is preferably at least about 1¼ inches from the front edge to the back edge, although for some applications it may be preferred to use larger battens of at least about 2 inches, and even at least about 3 inches, from the front edge to the back edge.

In the construction of the battens of this invention, the struts of series 15 are spaced at least about ⅜ inch apart, though they may be ½ inch apart or even further, as much as 1 inch apart The spacing is limited by the desired strength and load support for the batten, the choice of plastic, as well as the other dimensions of the batten.

Figure 4:
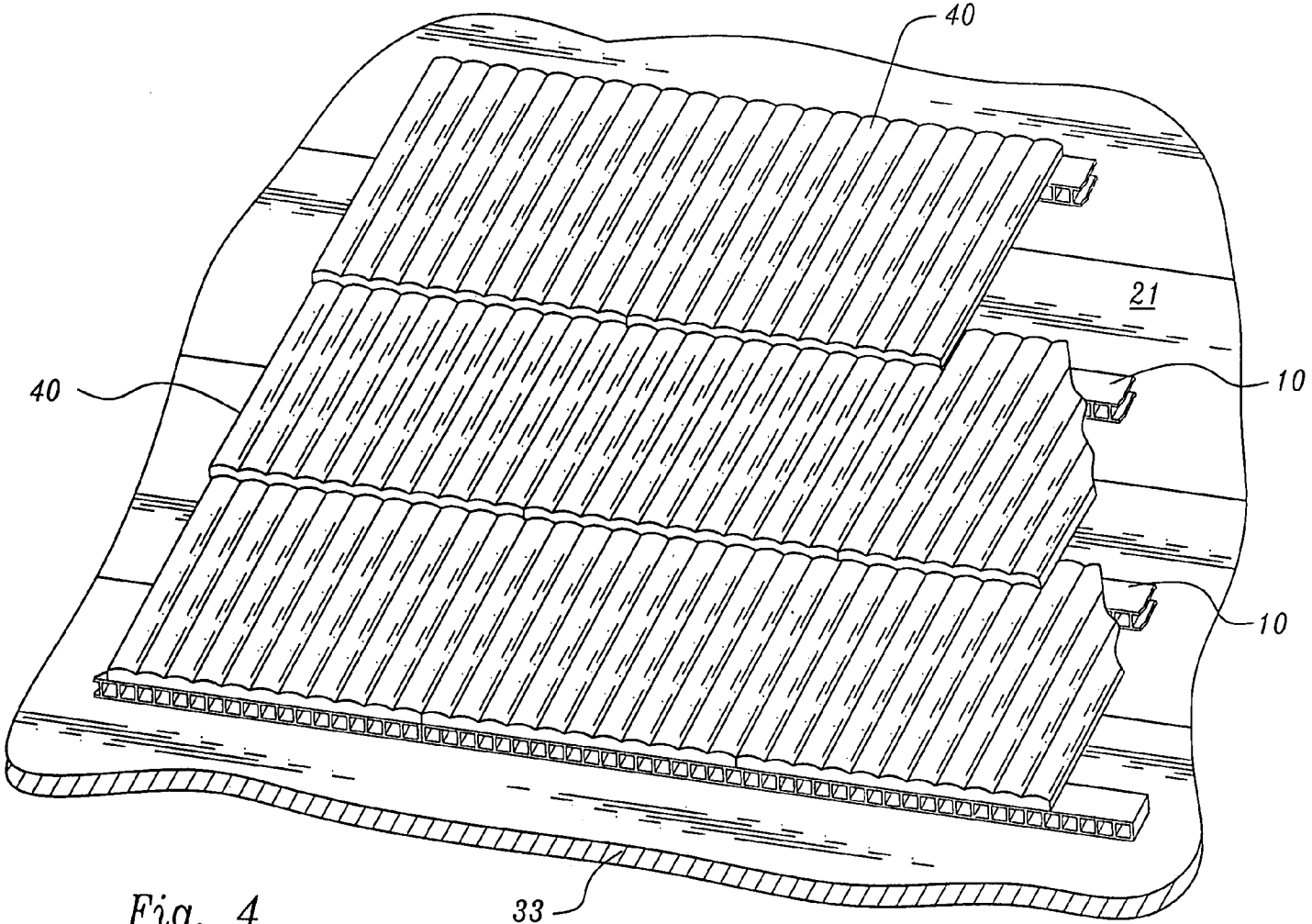
FIG. 4 is a perspective view of the deployment cement roof tiles on the battens of this invention.

The construction permits the inclusion of larger chambers, with at least about ⅜ inch, and more preferably, at least about ½ inch between spaced struts. This provides an area of at least about 1 square centimeter between each strut, which allows the necessary fluid communication of both air and water, and is large enough that the individual chambers are not easily occluded by dirt and debris. As seen in FIG. 4, there are spaces on the roof in the spaces under the tiles 40 and between rows of battens 10 where such accumulations typically take place over time.

In design, the thickness of each strut 15, is at least about 1/32 inch and can be greater, depending on the requirements of the batten, up to at least about 3/16 inch thick. Struts of about ⅛ are useful for most applications.

Figure 5:
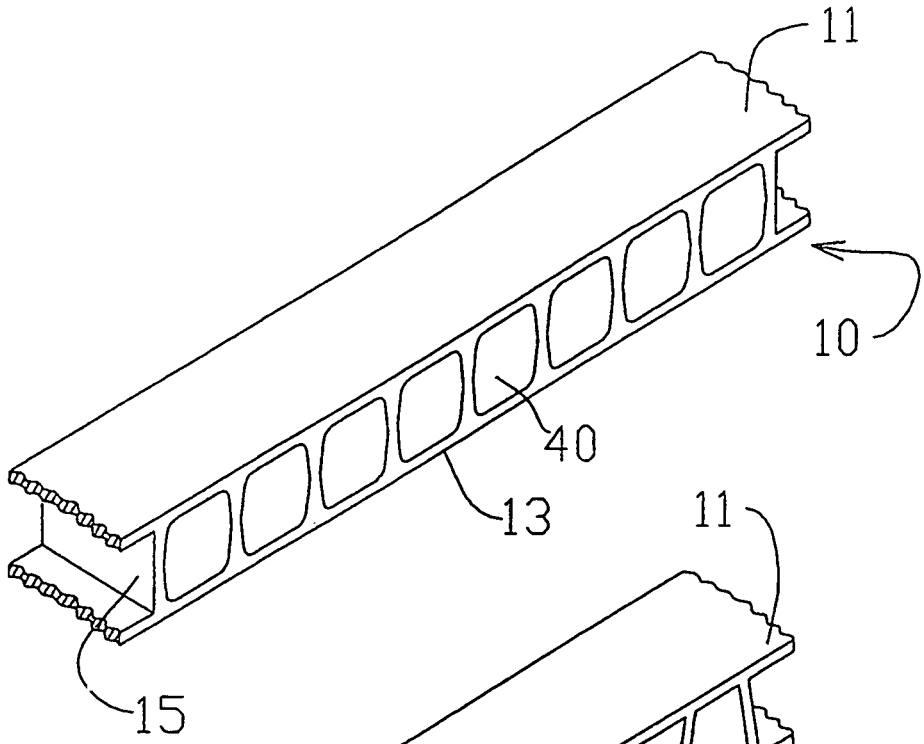
FIG. 5 is a front elevational view of a batten of this invention, showing an alternate construction.

Alternatively, as seen best in FIG. 5, the struts 15 may taper slightly, increasing in thickness by at least about 10%, 20% or even 30% or more, as they approach the connection of the struts 15 with each of the upper and lower surfaces.

The thickness of the upper and lower 11 and 13 surfaces may be comparable to that of the struts 15, though in some applications a smaller thickness may be appropriate, as the surfaces do not directly bear the load placed on the batten 10 as the struts 15 do.

The struts 15 are preferably spaced regularly with chambers 40 generally aligned with one another. When the struts 15 are formed generally perpendicular to the upper and lower surfaces, each of the chambers 40 will have a generally rectangular profile when viewed from the front.

Figure 6:
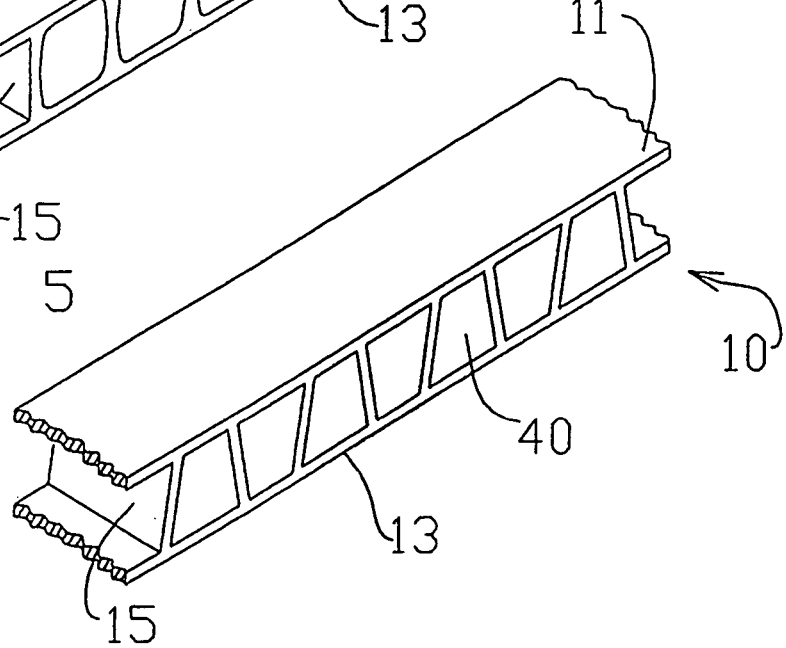
FIG. 6 is a front elevational view of a batten of this invention, showing a further alternate construction.

The struts 15 may also be formed to approach the upper and lower surfaces 11 and 13 at an angle (FIG. 6). As depicted in FIG. 6, a generally trapezoidal front profile is presented for each chamber 40, in alternating fashion.

The strength of the battens is provided by the combined features of the design, construction and material. The battens 10 provide a strong support for a load, yet have a cross-sectional profile optimized for fluid communication of the areas on the roof that are between battens. This optimal fluid communication permits both water drainage and a freer circulation of air through the chambers, which promotes drying of the roof surface beneath the tiles.

The battens are lightweight and strong, yet the structural elements, the surfaces and struts, are minimized, such that when viewed in cross-section, they occupy an area in profile that is less than the profile area of the chambers. This is important as the drainage and ventilation of the battens must be maximized.

Battens are most easily utilized in long strips from about 18 inches to 6 feet in length. The total elevation may be in the range from about ⅜ inch to about 1 inch from surface to surface. The roof batten is preferably produced with at least about 18 inches between ends, though the distance in most cases will be greater, at least about 36 inches, and often at least about 48 inches between the ends.

Plastics for use in producing the batten are well-known to the art, as are the methods of producing such an article from plastic. Plastics are chosen for various characteristics of strength, flexibility, thermal expansion, etc. Virtually any desired color or shape and many combinations of the properties of hardness, durability, elasticity, and resistance to heat, cold, and acid can be obtained by varying the components and production methods used to produce the plastic. Depending on the intended end use, suitable plastics may include styrene, acrylonitrile butadiene styrene (ABS), polyethylene, polypropylene, rigid & flexible PVC, polycarbonate, and nylon. The plastic chosen may lead to the selection of particular extruders, automatic cut-off machines, vacuum sizers and cooling techniques.

For example, polypropylene is a generally more versatile polymer than polyethylene, and is used both as a plastic and as a fiber. Polypropylene is better suited for use in products subjected to extreme conditions, as it can be produced in a form that will not melt below 160 C, or 320 F. Polyethylene, which is a more common plastic, will anneal at around 100 C, which means that polyethylene products will warp under severe conditions that are possible on a hot roof in certain geographic regions.

Polypropylene is also a plastic noted for its light weight, being less dense than water, and in that it resists moisture, oils, and solvents.

While polypropylene is a preferred plastic for making the battens, new plastics, and new manufacturing processes for new and old plastics, and composites are continuously under development, using various forming, molding, casting, and extrusion processes. Other plastics, improved plastics, or composite materials like fiberglass may find use in various applications for the roof battens, so long as the final product has physical properties that can withstand the extreme weather conditions of the roof environment, with extreme humidity and temperature fluctuations over the seasons.

Currently, many recycled plastics end up as low-grade plastic lumber. The battens described herein may provide another major end use for recycled plastics.

A roof batten having the desired characteristics may be produced by conventional injection molding techniques, though the roof batten is advantageously produced by extrusion. Profile extrusions are often a lower cost alternative to injection molding. In profile extrusions plastics are extruded in continuous lengths and cut. The cuts are selected so that individual battens are formed by cutting the extruded sheet along adjacent front and back edges of adjacent battens. Methods are well know to the art for material selection, part and die design, development and manufacturing to customize the part from profile extrusion for a particular application.

Extrusion methods include hot extrusion, cold extrusion, co-extrusion, dual or multi-durometer extrusion, hydrostatic extrusion, impact extrusion, pultrusions, reverse or backwards extrusion, and wire drawing. Hot-working extrusion processes use the good deformability of heated metallic or thermoplastic materials for shaping them. Extrusion at elevated temperatures enables considerable changes of shape to be achieved in a single operation where otherwise shaping them is impractical.

The battens may be produced by a method comprising the steps of extruding a sheet of plastic through a die, where the die has a cross-sectional profile configured to produce spaced, generally parallel upper and lower surfaces and a series of struts connecting the upper and lower surfaces, where the upper and lower surfaces and the struts have a thickness of at least about 1/32 inch, the spaced surfaces are separated by at least about ⅝ inch, and the struts are spaced so as to form hollow chambers therebetween extending in the direction of extrusion.

The extruded plastic is cut transversely to the direction of extrusion so as to provide a series of roof battens having front and back edges separated by at least about 1¼ inch. The struts will be spaced regularly and the chambers generally aligned with one another, according to the die.

It will be understood, of course, that an entire batten, for example, forty eight inches long, will be formed simultaneously, by a single cutting or shearing operation transverse to the direction of extrusion, thereby cutting the finished batten from the material. A sheath knife capable of cutting the entire length of the batten in a single cut may be applied, though depending on the materials and construction, certain battens may be damaged by such an operation. A saw is used in this situation, though other cutting alternatives include pressure water and laser cutting techniques.

After cutting, further processing of the battens may be done, such as marking for lengths, or pre-punching nail holes of a specific interval for ease of installation. Where the battens are constructed with dimensions and materials to allow installation by staples, no such pre punching or drilling will be necessary.

A white plastic roof battens will be preferred for use in some climates, since white reflects heat away and the instant battens are easily visible. White battens are also less likely to absorb heat and deform when exposed to the harsh conditions frequently found on the roof.

The battens are easy to produce, low in price, lightweight, strong, and easily installed. The plastic for the batten is non-toxic, thus offering an excellent alternative to chemically treated wood. Plastic battens will not leach toxic chemicals, and will outlast comparable treated wood.

Wood battens will absorb water and further hold water against the roof, which promotes rotting of both the batten and the underlayment. Wood battens may be harmed by the elements even prior to installation on the roof, and must be protected during shipment and storage from moisture and heat. Often wood battens are discovered to be unsuitable for installation, having already been infested, such as by termites, curled, split, cracked or rotted by the time they are received at the site of installation. Warped battens are obviously unsuitable for tiling, while split, cut or jagged portions of wood battens can cause damage and tearing to the felt underlayment.

With the relatively large chambers, the open fluid design of the present batten provides superior ventilation and drainage to eliminate the pooling of water on the roof surface. Further, as the battens are produced integrally of a single piece, unlike other prior art plastic battens they will not readily warp, and can not split or be pulled apart under extreme conditions experienced on a roof, through cycles of heat expansion and contraction, as well as dramatic changes in humidity. The battens are produced without snags or jagged corners, further minimizing damage to the underlayment.

The present battens are strong enough to be stepped on by roofers and strong enough to retain the lugs of the tiles, and yet the dimensions of the surfaces and struts, the structural elements, are such that when viewed from the front, they occupy an area in profile that is less than the profile area of the chambers, making the battens very light.

FIG. 3 shows how the batten 10 of this invention is attached as noted by stapling or nailing to a felt or roof paper 21 covered sheathing 33 of roof 30. In FIG. 4, roof tiles 40 are seen resting or disposed upon a batten 10 of a typical roof 30. The battens can be utilized with any type of roof tile 40; including, cement, clay, slate, or metal, that has a lip that can rest upon and slightly over the back edge of the batten. That is, the tile 40 overlays the upper surface 11 and part of the rear surface of the batten during the course of installation of the tiles. It is to be noted that the term roof tile is not limited to cement or ceramic material but also includes individual sections made of the other enumerated materials. Any lugged roof product is supportable thereon. The roof tiles may be interlocking tiles with anchor lugs.

The battens 10 are installed horizontally directly to solid sheathing 33, or over an underlayment 21 applied to the sheathing, and parallel to the eave and spaced in accordance with the roof tile manufacturer's instructions. The chambers 40 of the battens 10 are oriented to allow water to drain down the slope and pass through the batten openings.

In a typical installation of the battens 10, three extra staples are used as compared to conventional wood battens. However, use of the lighter battens 10 means that more can be carried at one time, making them easier set into position upon the roof 30, such that when linearly installed, as shown in FIG. 4 and properly overlaid with a course of tiles 40, the battens can reduce the overall installation time.

The battens 10 are attached in conventional ways know to the art in roofing installation. Generally, a batten is place at a 180 degree angle straight across the sheathing with its lower surface in contact with the underlayment, or roofing paper 21, followed by nailing, stapling or screwing through both surfaces 11 and 13 into the sheathing 33.

For a batten ⅝ inch deep, the battens should be fastened with 1 and ¼-inch-long or longer staples. If used with double felting or installing on a pitch of 7 in 12 or greater, 1 and ½-inch-long staples are preferably used. Air pressure should be adjusted so each staple is flush with the surface of the batten.

For example, the battens may be fastened to the roof deck with 1 and ¼-inch-long-by-1-inch-crown (31.7 mm by 25 mm), No. 16 gage, corrosion-resistant staples. Alternatively, longer staples having a smaller 7/16-inch-crown may be used to install the battens. In the latter case, shake staple guns may be used. In any case, the staple crown is generally installed parallel to the length of the batten, and spanning the vertical struts.

Battens are typically fastened at six-inches on center with the outside fasteners placed 1-inch from the outside edge of the batten. Thus, from left to right staples will be placed as follows: 1", 6", 12", 18", 24", 30", 36", 42", 47".

The battens described herein solve the problem of drainage and ventilation, and will not allow water to pond on the roof surface. Water will flow down and off the roof while air flowing up through the fluted battens promotes drying and preserves the life of the felt underlayment. Such ventilation is extremely important when it comes to extending the life of a tile roof.

It should readily be seen that the battens, with a greatly increased area dedicated to fluid communication, over prior designs, will help to prevent pooling of water even where debris has accumulated in regions under the tile. Water will flow down and off the roof while air flowing up through the chambers promotes drying and preserves the life of the felt underlayment, even with such debris accumulations that would plug the drainage of previous designs, because of the very open design, with a greater total cross-sectional area in open chambers than in plastic structure, including surfaces or struts.

There is provided, then, a new batten for clay, concrete, and other tiles that is easy to install as by nailing or stapling. The present invention provides a great improvement in a roof batten, both in ease of manufacture and use and in the ability to provide superior ventilation and drainage of the roof surface underlying the tile.

The following example is intended to illustrate but not to limit the invention.

Example 1

A roof batten is made by an extrusion process, using polypropylene heated and passed through a die to give the following dimensions. The batten is ½ inch high (12.7 mm), and 48 inches (1219 mm) long.

The plastic support structures of the battens are 0.044-inch-thick (1.12 mm) along the top and bottom surfaces, and 0.038-inch-thick (0.97 mm) in the region at the center of each of the vertical struts, gradually increasing in the outer regions of the struts closer to the interface with the surfaces, to about 0.062 inch thick (1.57 mm). The struts and upper and lower surfaces form chambered openings measuring 0.372 inch wide by 0.412 inch high (0.94 by 1.05 cm). One-hundred and fourteen chambers are formed in the batten.

Viewed from the front, each chamber of the batten has a square area of approximately 0.987 cm. From the same front view, the square area occupied by the plastic structural elements, surfaces and struts, corresponding to each chamber, is only about 0.33 cm. Thus, it is readily seen that in the batten construction a far greater area is dedicated to the fluid communication chambers, with a minimal area occupied by structural elements, of a factor of about three to one.

Extruded sheets are cooled and stacked four deep, and then cut to 1½ inches (38 mm) wide using a saw blade.

The extruded polypropylene batten is lightweight, capable of supporting 200 pounds of pressure over an area 3 inches in diameter, and may be affixed to a roof by any of nailing, stapling, or screwing means. The battens are conveniently attached by a conventional roofing staple, so they are quickly and easily secured to a roof, yet they receive and support the roofing tiles conveniently.

A series of such battens used in supporting a roof creates a region underneath the tiles that is in open fluid communication across the surface of the roof, permitting rapid drainage of water, and open communication and circulation of air beneath the tiles, facilitating rapid drying across the roof surface of any water that penetrates the tiles.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A roof batten comprising spaced, generally parallel upper and lower surfaces with a series of struts connecting the upper and lower surfaces, wherein the spaced surfaces are elongated having a front edge, a back edge and side ends peripheral to the surfaces, wherein the struts are spaced from one another, said struts and surfaces forming a series of chambers for fluid passage, wherein the upper and lower surfaces and the struts are formed having a thickness of at least 1/32 inch, wherein the struts and the upper and lower surfaces are integrally-formed of plastic, and wherein the spaced surfaces are separated by at least 5/16 inch.

2. The batten of claim 1, wherein the batten is capable of supporting 200 pounds of pressure over an area 3 inches in diameter with no noticeable effect.

3. The roof batten of claim 1, wherein the struts are spaced regularly.

4. The roof batten of claim 1, wherein when viewed in front profile the area of the upper and lower surfaces and struts occupies less than about 50% of the area of the chambers.

5. The roof batten of claim 4, wherein when viewed in front profile the area of the upper and lower surfaces and struts occupies less than about 40% of the area of the chambers.

6. The roof batten of claim 5, wherein when viewed in front profile the area of the upper and lower surfaces and struts occupies less than about 33% of the area of the chambers.

7. The roof batten of claim 1, wherein the plastic is susceptible of being affixed to a roof by any of nailing, stapling, or screwing means.

8. The roof batten of claim 1, wherein the plastic is polypropylene.

9. The roof batten of claim 1, wherein the batten has a recycled plastic content.

10. The roof batten of claim 1, wherein the spaced surfaces are separated by at least ½ inch.

11. The roof batten of claim 1, wherein the batten is at least 1¼ inches from the front edge to the back edge.

12. The roof batten of claim 1, wherein the batten is at least 2 inches from the front edge to the back edge.

13. The roof batten of claim 1, wherein the batten is at least 3 inches from the front edge to the back edge.

14. The roof batten of claim 1, having at least ⅜ inch between spaced struts.

15. The roof batten of claim 1, having at least ½ inch between spaced struts.

16. The roof batten of claim 1, wherein the chambers have an average cross-sectional profile having an area of at least 1 square centimeter.

17. The roof batten of claim 1, wherein the batten is at least 18 inches between the ends.

18. The roof batten of claim 1, wherein the batten is at least 36 inches between the ends.

19. The roof batten of claim 1, wherein the batten is at least 48 inches between the ends.

* * * * *